US008068062B2

(12) United States Patent
Webb et al.

(10) Patent No.: US 8,068,062 B2
(45) **Date of Patent: *Nov. 29, 2011**

(54) PORTABLE ANTENNA POSITIONER APPARATUS AND METHOD

(75) Inventors: Spencer Webb, Pelham, NH (US); David Martin, Nashua, NH (US)

(73) Assignees: GBS Positioner, LLC., Nashua, NH (US); AntennaSys, Inc., Pelham, NH (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/986,891

(22) Filed: Jan. 7, 2011

(65) Prior Publication Data

US 2011/0169696 A1 Jul. 14, 2011

Related U.S. Application Data

(63) Continuation of application No. 12/236,149, filed on Sep. 23, 2008, now Pat. No. 7,889,144, which is a continuation of application No. 11/412,720, filed on Apr. 26, 2006, now Pat. No. 7,432,868, which is a continuation-in-part of application No. 11/115,960, filed on Apr. 26, 2005, now Pat. No. 7,173,571.

(60) Provisional application No. 60/521,436, filed on Apr. 26, 2004.

(51) Int. Cl.
*H01Q 3/00* (2006.01)

(52) U.S. Cl. ..... 343/766; 343/881; 343/882

(58) Field of Classification Search ..... 343/766, 343/880, 882, 881, 765, 702, 700 MS
See application file for complete search history.

(56) References Cited

U.S. PATENT DOCUMENTS 4,656,486 A * 4/1987 Turner ..... 343/882
4,694,301 A * 9/1987 Wassum ..... 343/720

(Continued)

FOREIGN PATENT DOCUMENTS

WO WO 99/22422 5/1999

(Continued)

OTHER PUBLICATIONS

Norsat International Inc., GlobeTrekker, The Intelligent Backpackable Satellite System, http://www.norsat.com/n21100.asp, 10 pages.

(Continued)

*Primary Examiner* — Hoanganh Le
(74) *Attorney, Agent, or Firm* — ARC IP Law, PC; Joseph J. Mayo

(57) ABSTRACT

A low power, lightweight, collapsible and rugged antenna positioner for use in communicating with geostationary, geosynchronous and low earth orbit satellite. By collapsing, invention may be easily carried or shipped in a compact container. May be used in remote locations with simple or automated setup and orientation. Azimuth is adjusted by rotating an antenna in relation to a positioner base and elevation is adjusted by rotating an elevation motor coupled with the antenna. Manual orientation of antenna for linear polarized satellites yields lower weight and power usage. Updates ephemeris or TLE data via satellite. Algorithms used for search including Clarke Belt fallback, transponder/beacon searching switch, azimuth priority searching and tracking including uneven re-peak scheduling yield lower power usage. Orientation aid via user interface allows for smaller azimuth motor, simplifies wiring and lowers weight. Tilt compensation, bump detection and failure contingency provide robustness.

30 Claims, 14 Drawing Sheets

U.S. PATENT DOCUMENTS

| | | | | |
|---|---|---|---|---|
| 4,811,026 | A * | 3/1989 | Bissett | 343/766 |
| 4,816,838 | A * | 3/1989 | Mizuno et al. | 343/771 |
| 4,868,578 | A | 9/1989 | Bruinsma | |
| 5,019,833 | A | 5/1991 | Nomaka | |
| 5,020,137 | A | 5/1991 | Barsumian | |
| 5,061,945 | A | 10/1991 | Hull | |
| 5,404,583 | A | 4/1995 | Lalezari | |
| 5,542,104 | A | 7/1996 | Ozawa | |
| 5,646,638 | A | 7/1997 | Winegard | |
| 5,819,185 | A | 10/1998 | Umezawa | |
| 5,915,020 | A | 6/1999 | Tilford | |
| 6,867,740 | B2 | 3/2005 | Goodyear | |
| 7,015,871 | B2 | 3/2006 | Gottl | |
| 7,173,571 | B2 * | 2/2007 | Webb et al. | 343/766 |
| 7,432,868 | B2 * | 10/2008 | Webb et al. | 343/766 |
| 7,889,144 | B2 * | 2/2011 | Webb et al. | 343/766 |
| 2001/0046258 | A1 | 11/2001 | Wise | |
| 2005/0162325 | A1 | 7/2005 | Tietjen | |
| 2009/0231224 | A1 | 9/2009 | Felstead | |

FOREIGN PATENT DOCUMENTS

| | | |
|---|---|---|
| WO | WO 02/075842 | 9/2002 |
| WO | WO 02/075847 | 9/2002 |

OTHER PUBLICATIONS

AVL Technologies, Antenna Positioner, http://www.avltech.com/rotoLok.php, Auto-acquisition system, http://www.avltech.com/avl_pdf/90x66Ku_iSNG.pdf, 1 page.

TracStar Systems, Mobile Broadband Satellite Communications, http://www.tracstar.net, 2 pages.

Microwave Radio Communications (MRC), Satellite Systems, retrieved from http://www.mrcbroadcast.com/products_core/satellite.html on Dec. 23, 2006, 3 pages.

Titan, AN/USC-66 Ka-Band SATCOM Terminal (KaSAT), http://www.titan.com/products-services/abstract.html?docID=340, 2 pages.

Patriot, 76cm Flyaway Systems, http://www.sepatriot.com/Specs%202005/76fly.pdf, 2 pages.

Cheetah .9M Auto-Acquire Flyaway VSAT, http://www.globalcoms.com/products_vsat_cheetah.asp, Hawkeye Series AUTO-ACQUIRE Terminals, http://www.globalcoms.com/products_vsat_Hawkeye.asp, 2 pages.

SWE-DISH, IPT MIL SUITCASE, retrieved from http://www.swedish.com/templates/page.asp?id=2018 on Dec. 23, 2006, 3 pages.

GSI Globecomm Systems, Explorer .77M Satellite Communication Terminal, Mobile Earth Stations, http://www.globecommsystems.com/pdf/0.77AutoExplorer.pdf, 4 pages.

Tachyon Networks Inc, AUTO DEPLOY CPE, http://www.tachyon.net/services_and_technology/data_sheets/DataSheet-AutoDeploy.pdf#search=%22Auto%20Deploy%20CPE%22, 2 pages.

Norsat International Inc., Ultra-Portable Manpackable Terminal, http://www.norsat.com, 2005, 2 pages.

Avl Technologies, Roto-Lok Drive System and Antenna Positioners, retrieved from http://www.avltech.com/rotoLok.php on Dec. 23, 2006, 2 pages.

Avl Technologies, Model 9066K iSNG Carry-On 90cm× 66cm Auto-Acquisition Case Based Antenna, www.Avltaech.com, 2 pages.

TracStar Systems, Two-Way Broadband Satellite Communications Antennas, retrieved from http://www.tracstar.net/twoway.html on Dec. 23, 2006, 4 pages.

Microwave Radio Communications, Advent Communications, "MANTIS" 1 meter Single Box Antenna, 2 pages.

Cheetah Auto-Acquire Flyaway VSAT, retrieved from http://www.globalcoms.com/products_vsat_cheetah.asp on Dec. 23, 2006, 2 pages.

Hawkeye Lite v2 1M Auto-Acquire FlyAway VSAT, www.globalcoms.com, May 2006, 2 pages.

International Search Report, dated Nov. 1, 2006 (8 pages).

European Supplemental Search Report, dated Feb. 16, 2009 (6 pages).

Canadian Search Report, dated Aug. 10, 2010 (4 pages).

* cited by examiner

PORTABLE ANTENNA POSITIONER APPARATUS AND METHOD

This application is a continuation of U.S. Utility patent application Ser. No. 12/236,149, filed Sep. 23, 2008 now U.S. Pat. No. 7,889,144 which is a continuation of U.S. Utility patent application Ser. No. 11/412,720, now U.S. Pat. No. 7,432,868, filed Apr. 26, 2006, which is a continuation in part of U.S. Utility patent application Ser. No. 11/115,960, now U.S. Pat. No. 7,173,571, filed Apr. 26, 2005, which claims the benefit of U.S. Provisional Patent Application Ser. No. 60/521,436 filed Apr. 26, 2004, the specifications of which are all hereby incorporated herein by reference.

This invention was made with Government support under F19628-03-C-0039 awarded by US Air Force, Department of Defense. The Government has certain rights in the invention.

BACKGROUND OF THE INVENTION

1. Field of the Invention

Embodiments of the invention described herein pertain to the field of antenna positioning systems. More particularly, but not by way of limitation, these embodiments enable the positioning of antennas by way of a compact, lightweight, portable, self-aligning antenna positioner that is easily moved by a single user and allows for rapid setup and alignment.

2. Description of the Related Art

An antenna positioner is an apparatus that allows for an antenna to be pointed in a desired direction, such as towards a satellite. Many satellites are placed in geosynchronous orbit at approximately 22,300 miles above the surface of the earth. Other satellites may be placed in low earth orbit and traverse the sky relatively quickly. Generally, pointing may be performed by adjusting the azimuth and elevation or alternatively by rotating the positioner about the X and Y axes. Once oriented in the proper direction, the antenna is then best able to receive a given satellite signal.

Existing antenna positioners are heavy structures that are bulky and require many workers to manually setup and initially orient. These systems fail to satisfactorily achieve the full spectrum of compact storage, ease of transport and rapid setup. For example, currently fielded antenna systems capable of receiving Global Broadcast System transmissions comprise an antenna, support, positioner, battery, cables, receiver, decoder and PC. These antenna systems require over a half dozen storage containers that each require 2 or more workers to lift. Other antenna systems are mounted on trucks and are generally heavy and not easily shipped.

BRIEF SUMMARY OF THE INVENTION

Embodiments of the invention provide a lightweight, collapsible and rugged antenna positioner for use in receiving low earth orbit and geosynchronous satellite transmissions. By collapsing the antenna positioner, it may be readily carried by hand or shipped in a compact container. For example, embodiments of the invention may be stored in a common carry-on bag for an airplane. The antenna positioner may be used in remote locations with manually assisted or automated setup and orientation. Embodiments of the invention may be produced at low cost for disposable applications. The apparatus can be scaled to any size by altering the size of the various components. The gain requirements for receiving any associated satellite transmission may be altered by utilizing more sophisticated and efficient antennas as the overall size of the system is reduced.

The movement of an antenna coupled with embodiments of the portable antenna positioner allows for low earth orbit, geostationary or geosynchronous location and tracking of a desired satellite. Since the slew rate requirements are small for geosynchronous satellites, the motors used in geosynchronous applications may be small.

One embodiment of the invention may be used, for example, after extending stabilizer legs and an adjustable leg to provide a stable base upon which to operate. In embodiments with a battery coupled with the apparatus, the antenna is extended and the system is aligned near a desired satellite at which time the system searches for and finds a desired satellite. The entire setup process can occur in rapid fashion. Another embodiment of the invention may utilize alternate mechanical positioning devices such as an arm that extends upward and allows for azimuth and elevation motors to adjust the antenna positioning. Another embodiment of the invention utilizes a smaller azimuth motor and limited range in order to lower the overall weight of the apparatus.

One or more embodiments utilize an adjustable leg or legs that may be motorized with for example a stepper motor. These embodiments are able to alter the effective elevation angle of a satellite relative to the apparatus so that the satellite is far enough away from the zenith to prevent "keyholing".

In one embodiment of the invention, positioning of an associated antenna is performed by rotating positioner support frame in relation to a positioner base in order to set the azimuth. Setting the elevation is performed by altering the angle of the antenna mounting plate with respect to the positioner support frame. Since the elements are rotationally coupled to each other, rotation of the positioning arm alters the angle of the antenna mounting plate in relation to the positioner support frame. The motion of the antenna alters the angle of the antenna with relation to the positioner base. The resulting motion positions a vector orthogonal to the antenna mounting plate plane in a desired elevation and with the positioner base rotated to a desired azimuth, the desired pointing direction is achieved. Another embodiment of the invention makes use of an arm that comprises azimuth and elevation motors that are asserted in order to point an antenna to a desired pointing direction.

The pointing process is normally accomplished via powered means using the mechanisms described above. Various components are utilized by the apparatus to accomplish automated alignment with a desired satellite. A GPS receiver is used in order to obtain the time and the latitude and longitude of the apparatus. In addition, a tilt meter (inclinometer) or three axis accelerometer and magnetometer are be used to determine magnetic north and obtain the pointing angle of the antenna. By placing a group of sensors in both the electronics housing and antenna housing, differential measurements of tilt or magnetic orientation may be used for calibration purposes and this configuration also provides a measure of redundancy. For example, if the magnetometer in the positioner base fails, the magnetometer coupled with the antenna or in the antenna housing may be utilized. Such failure may be the result of an electronics failure or a magnetic anomaly near the positioner base. A low noise block down converter (LNB) along with a wave guide allows high frequency transmissions to be shifted down in frequency for transmission on a cable. One or more embodiments of the invention comprise a built-in receiver that enables the apparatus to download ephemeris data and program guides for channels. Motors and motor controllers to point the antenna mounting plate in a desired direction are coupled with at least one positioning arm in order to provide this functionality. Military Standard batteries such as BB-2590/M for example may be used to drive the motors. Any other battery of the correct voltage may also be utilized depending on the application. A keypad may be used in order to receive user commands such as Acquire, Stop, Stow and Self-Test. A microcontroller may be programmed to accept the keypad commands and send signals to the azimuth, elevation and optional adjustable leg motor in order to achieve the desired pointing direction based on a satellite orbit calculation based on the time, latitude, longitude, north/south orientation and tilt of the apparatus at a given time and the various orbital elements of a desired satellite. Optionally, a PC may host the satellite orbit program and user interface and may optionally transfer commands and receive data from the apparatus via wired or wireless communications.

By way of example an embodiment may weigh less than 20 pounds, comprise an associated antenna with 39 dBic gain, LHCP polarization, frequency range of 20.2 to 21.2 GHz and fit in an airplane roll-on bag of 14×22×9 inches. Embodiments of the invention may be set up in a few minutes or less and are autonomous after initial setup, including after loss and subsequent restoration of power. Although this example embodiment has a limited frequency range, any type of antenna may be coupled to the apparatus to receive any of a number of transmissions from at least the following satellite systems.

| User | Frequency | Polarization | Tracking |
|---|---|---|---|
| 1. GBS User | 11 GHz Rx<br>20.2 GHz Rx | LP<br>LHCP | GeoSynch NSK<br>Self Aligning |
| 2. GBS + Milstar | (1) Plus<br>20.2 GHz Rx<br>44 GHz Tx | RHCP<br>RHCP | GeoSynch NSK<br>Self Aligning |
| 3. Weather Only | 1.7 MHz<br>2.2-2.3 MHz | LP<br>RHCP | LEO Tracking<br>91° Retrograde<br>Up to 15°/Sec |
| 4. GBS + Weather | (1) Plus (3) | | |
| 5. Weather or DSP Low<br>Rate Downlink (LRD) | 1.7 MHz<br>2.2-2.3 MHz | LP<br>RHCP | GeoSynch<br>Point and Forget |
| Weather NPOESS High<br>Rate Downlink (HRD) | (5) Plus<br>8 Ghz | RHCP | Polar LEO<br>Tracking for<br>8 GHz |
| 6. Wideband Gap Filler<br>(WGS) SHF Low | 7.9-8.4 GHz<br>Tx<br>7.25-7.75 GHz<br>Rx | RHCP<br>LHCP | GeoSynch NSK<br>Self-Aligning |
| 7. WGS EHF High | 30 GHz Tx<br>20 GHz Rx | RHCP<br>RHCP | GeoSynch NSK<br>Self-Aligning |

Any other geosynchronous or low earth orbiting satellite may be received by coupling an appropriate antenna to the apparatus. For example, a dish or patch array antenna may be coupled to the antenna mounting plate. An example calculation of the size of dish or patch array to achieve desired gains follows. An ideal one-meter dish, at 20 GHz, has a gain of 46.4 dBi. With 68% efficiency, it would have a gain of 44.7 dBi. A one-half meter diameter dish, therefore, would be 6 dB less, for a gain of 38.7 dBi. Certain patch arrays have efficiencies on the order of 30%, or about 3.6 dB below a dish of similar area. A patch array with a gain of 39 dBi would have an area of 0.474 square meters. A dish with a gain of 39 dBi would have an area of 0.209 square meters, or a diameter of 0.516 meters. For a patch array consisting of four panels, this implies each panel should have an area of 0.119 square meters, or 184 square inches. This is a square with sides of 13.6 inches. A panel that measures 20 in. by 12 in. has an area of 240 square inches (0.155 square meters). For the 4-panel system, the area is 960 square inches or 0.619 square meters; with a calculated gain of 40.2 dBi. Embodiments of the invention are readily combined with these example antennas and any other type of antennas. Optionally a box horn antenna may be coupled with the apparatus that is smaller and more efficient than a patch array antenna, but that is generally heavier and thicker. Additionally a wave guide fed slot array may be utilized.

Position Sensors used in embodiments of the invention allow for mobile applications. One or more accelerometer and/or gyroscope may be used to measure perturbations to the pointing direction and automatically adjust for associated vehicle movements in order to keep the antenna pointed in a given direction.

Some example components that may be used in embodiments of the invention include the Garmin GPS 15H-W, 010-00240-01, the Microstrain 3DM-G, the Norsat LNB 9000C the EADmotors L1SZA-H11XA080 and AMS motor driver controllers DCBi-241. These components are exemplary and non-limiting in that substitute components with acceptable parameters may be substituted in embodiments of the invention.

In addition, one or more embodiments of the invention may comprise mass storage devices including hard drives or flash drives in order to record programs or channels at particular times. The apparatus may also comprise the ability to transmit data, and transmit at preset times. Use of solar chargers or multiple input cables allows for multiple batteries or the switching of batteries to take place. The apparatus may search for satellites in any band and create a map of satellites found in order to determine or improve the calculated pointing direction to a desired satellite. The apparatus may also comprise stackable modules that allow for cryptographic, routing, power supplies or additional batteries to be added to the system. Such modules may comprise a common interface on the top or bottom of them so that one or more module may be stacked one on top of another to provide additional functionality. For lightweight deployments all external stackable modules including the legs may be removed depending on the mission requirements.

Low power embodiments of the invention employ a limited range of motion in azimuth for the antenna positioner which allows the operator to be presented with an "X" in a box of the user interface. The operator sets the system to point within 60 degrees of a satellite, not 360 degrees. The system then prompts the user with the "X" which is on the left of the box if the operator should rotate the positioner base to the left and the "X" appears on the right side of the box if the operator is to rotate the positioner base to the right. Once the positioner base is within 30 degrees, the operator asserts a button and the system begins to acquire a satellite.

The system may employ tilt compensation so that even if the positioner base is not level, the scan includes adjustment to the elevation motor so that the scan lines are parallel to the horizon not to the incline on which the positioner base is situated. The three-axis accelerometer is used to provide tilt measurements in one or more embodiments of the invention.

The search algorithm utilized by the system may be optimized to search in azimuth and sparsely search in elevation. This is due to the fact that magnetic anomalies are more prevalent than gravitational anomalies. The system looks first in azimuth before elevation (preferential azimuth searching) since that is where the errors are likely found. For example in one embodiment, the search proceeds to do two horizontal scan lines first above the initial point before performing two horizontal scan lines below the initial point. In other words, after the signal peaks, it goes to peak then leaves the raster scan algorithm then uses a box peaking algorithm right and up to a corner, go to a left corner, down to corner and right bottom corner, e.g., 5 measurements. Then the system points to the strongest and does the four corner measurements again. When the four corners of the box have equal strength the antenna is positioned correctly and the search algorithm terminates.

The system also is capable of manually-assisted linear polarization setting. When aligning the third axis, that is aligning the antenna about an axis orthogonal to the antenna plane for linear polarization, the operator may be prompted for rotating the antenna manually. This allows for the elimination of a third motor although this motor is optional and may be employed in embodiments that are not power sensitive. The linear polarization axis is the least critical of all of the axial settings, so a little error is acceptable. In addition, the system without a linear polarization axis motor is lower weight.

The system may also be configured for bump detection and reacquisition. In this configuration, the system detects when the base or the antenna is bumped and reacquires the satellite. If the satellite signal is still high, then the system returns to a four corner boxing algorithm for example, otherwise the system goes back into scan mode. With two three-axis accelerometers, one on positioner base and one on antenna, both may be used for bump detection.

In order to further save power and time in acquiring satellites, the age of the two line element (TLEs) is taken into account in one or more embodiments of the invention. This is known as Clarke Belt Fallback. For ephemeris data or two line elements, fresh TLE data allows the system to point to the satellite accurately. However, in a couple of weeks, the TLE information is out of date, in a couple of months is actually quite inaccurate. For perfectly stationary satellites on the Clarke belt, i.e., equator, all the system has to know is the longitude to find one of these satellites. The satellites that move have a problem in that a fresh TLE is more accurate than a Clarke Belt longitude, but after 30 days the system falls back to the Clarke Belt longitude since it is more accurate after about this time span. Without fresh TLEs, acquisition takes more time and power, but by using the Clarke Belt Fallback, the system can still function.

In another power saving embodiment, the tracking of the satellites may switch between transponder signal and the beacon tracking signal output by a satellite. Beacons have a different frequency and are lower power than the data signal of the satellite. The beacons are also omni-directional so the system can find the satellite even if it is not pointed at the system at the time of acquisition. For small low power antennas, the beacon may be too small to detect, so if the data signal via the satellite transponder is on, it can be used to find and lock onto the satellite even if the beacon is too weak to detect.

Embodiments of the positioner base may make use of a hole in the base such that water and other environmental elements do not collect in the positioner base where the antenna positioning elements are stored. In this embodiment, a thermal well may be employed wherein all of the heat-making components situated in the positioner base, i.e., the electronics utilized by the system, dissipate heat. With regards to saving power and minimizing heat dissipation, algorithms that conserve power may be utilized in one or more embodiments of the invention. For example, when tracking a geosynchronous satellite, e.g., one that move in a figure eight pattern but remains relatively in one general area of the sky, the system can stop tracking the satellite at the top and bottom of the figure eight since motion is relatively slow there. The system can switch to more rapid tracking when the satellite is scheduled to move from the upper to the lower portion of the figure eight since the satellite motion is fast during this period. Conserving power as determined by two-line element (TLE) determined re-peak schedule allows for lower power dissipation and longer battery life. The system may utilize distributed I2C thermal sensors. The sensors may be placed on the electronics boards utilized by the system for example, so the computer can self-monitor the components.

The system allows for updating TLEs over the data link acquired. This allows for fresh TLEs to be used in locating and tracking satellites. The broadcasters may be configured to send down TLEs that the system uses to automatically update the local TLEs. After one month, the TLEs are considered old and if the system is powered up, then it may automatically update the TLEs if the acquired satellite is configured to broadcast them.

Some embodiments of the invention allow for a quick disconnect for the antenna panel. This allows for different satellites having entirely different frequency bands to be acquired with the system. This quick disconnect capability may be implemented by using double pins to hook the antenna to positioning arm. By releasing one antenna and attaching another antenna to the positioning arm, a different set of satellites in general may be acquired since satellites use various frequencies. Linearly polarized satellites, generally commercial satellites, may be acquired using a third rotational motor that allows for the antenna to rotate about the axis pointing at a satellite. For low power configurations, this allows for the user to be prompted to rotate the antenna until the strength of the signal is maximized. Low power embodiments therefore do not require a third axis motor.

One or more embodiments of the invention provide an Integrated Receiver Decoder (IRD) slot. An IRD allows for set-top box functionality and may provide channel guide type functionality. The user interface to the IRD may include an IRD lock function that allows for feedback to the user for tracking qualification. If the IRD is integrated into the positioner base, the IRD can provide input to the positioner's computer or a visual display to the user to qualify the satellite as being identified as the desired satellite. In one small area of the sky, there may be five 5 commercial satellites in the field of view, so the system may prompt the user to select Next Satellite to continue looking for the correct satellite or the computer may automatically look to the next satellite.

Embodiments may utilize a "one button" or "no button" setup procedure. After opening the system and deploying the antenna and turning the power on, the system determines where it is and if pointed within a general direction of a satellite, requires no button pushes for the system to lock. The system can also perform the no button option so that after power loss and restore, the system re-acquires a satellite. This may occur with no intervention. One button operation may be utilized when the system is not rotated close enough to a satellite for example, where the system may prompt the user to rotate the base in one direction or the other and assert the acquire button. The prompt may include an "X" to the left or right in the LED screen to let the user know to turn the base clockwise or counterclockwise for example. The user interface may also present auto satellite options. For example, the first choice and second choice satellites may be presented to the user based on the band the system is configured for. Based on the location of the antenna on the planet, the user interface shows the operator the most likely satellite that is normally picked.

The system may also employ a failure contingency tree. For example if any portion of the system fails, the system may prompt the user via the display and allow the user to utilize the keyboard to respond to system requests for positioning the system, etc. For example, if the GPS or tilt fails, the system allows the operator to compensate for the error, prompts for entry on keyboard, of the GPS position or to acknowledge that the base is level. In short, the system is configured to ask the user for help if components break.

One or more embodiments of the invention allow for a sensor built into changeable antenna. For example, a 3 positioner accelerometer may be built into the changeable antenna panel. In addition, the antenna panel may be configured with memory in the changeable antenna that is used to notify the system what band the antenna is, so the system does not have to perform third axis rotation when not acquiring a satellite that uses linear polarization. For example, if acquiring a Ka band military satellite, the antenna panel is read and based on the fact that the Ka band antenna is being utilized, a whole set of the correct satellites in the correct band may be presented to the user via the user interface wherein some of all of the previous satellites receivable with the previous antenna are no longer presented. An additional tilt sensor may be utilized in the positioner base for crosschecking with antenna. Any redundant positioners may be placed throughout the system in order to provide redundancy and crosschecking capabilities.

The system has no loose parts and requires no tools. Since there are no parts to loose, the system is more robust. The system may include a camouflage bag that encapsulates the system and may be changed from desert to jungle to urban camouflage or black. Many different types of legs may be employed on the system depending on the terrain that the system is to be used in, including but not limited to legs with rubber bottoms, spikes or any other type of bottom, and the legs themselves may be of any type including telescoping or rigid or any other type.

DETAILED DESCRIPTION OF THE INVENTION

Embodiments of the invention provide a self contained lightweight, collapsible and rugged antenna positioner for use in receiving and transmitting to low earth orbit, geosynchronous and geostationary satellites. In the following exemplary description numerous specific details are set forth in order to provide a more thorough understanding of embodiments of the invention. It will be apparent, however, to an artisan of ordinary skill that the present invention may be practiced without incorporating all aspects of the specific details described herein. Any mathematical references made herein are approximations that can in some instances be varied to any degree that enables the invention to accomplish the function for which it is designed. In other instances, specific features, quantities, or measurements well-known to those of ordinary skill in the art have not been described in detail so as not to obscure the invention. Readers should note that although examples of the invention are set forth herein, the claims, and the full scope of any equivalents, are what define the metes and bounds of the invention.

Figure 1:
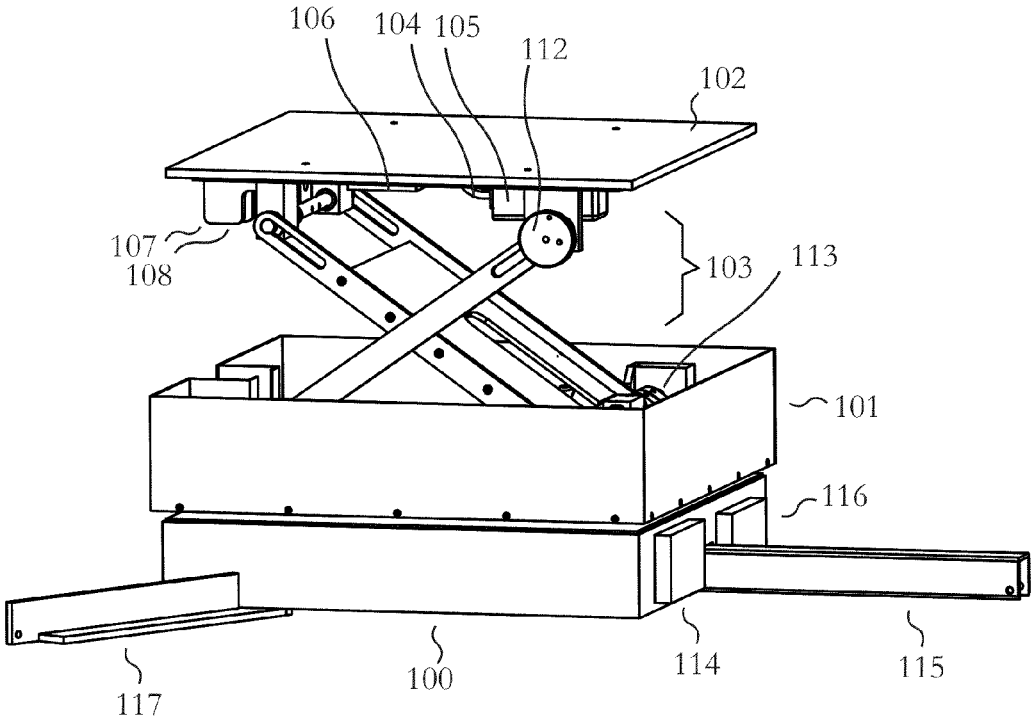
FIG. 1 shows a top perspective view of an embodiment of the invention in the deployed position.

FIG. 1 shows a top perspective view of an embodiment of the invention in the deployed position. Positioner base 100 may be coupled to the ground or any structure that can adequately support the apparatus. An embodiment with stabilizer leg 117 extended as well as adjustable leg 115 extended is shown in FIG. 1. The legs are optional and if an embodiment comprises legs, they are not required for use but may be used individually as required to provide stability based on the exact geography at the deployment site.

Positioner base 100 and positioner support frame 101 may be any geometrical shape although they are roughly shown as rectangular in FIG. 1. Positioner support frame 101 is rotationally mounted on positioner base 100. This rotational mounting allows for altering the azimuth setting of the apparatus. Keypad port 114 and GPS sensor port 116 allow for access to the respective elements housed internal to the positioner base during shipping. Optional or combined use of and control of the apparatus may be accomplished via a PC (not shown).

Figure 2:
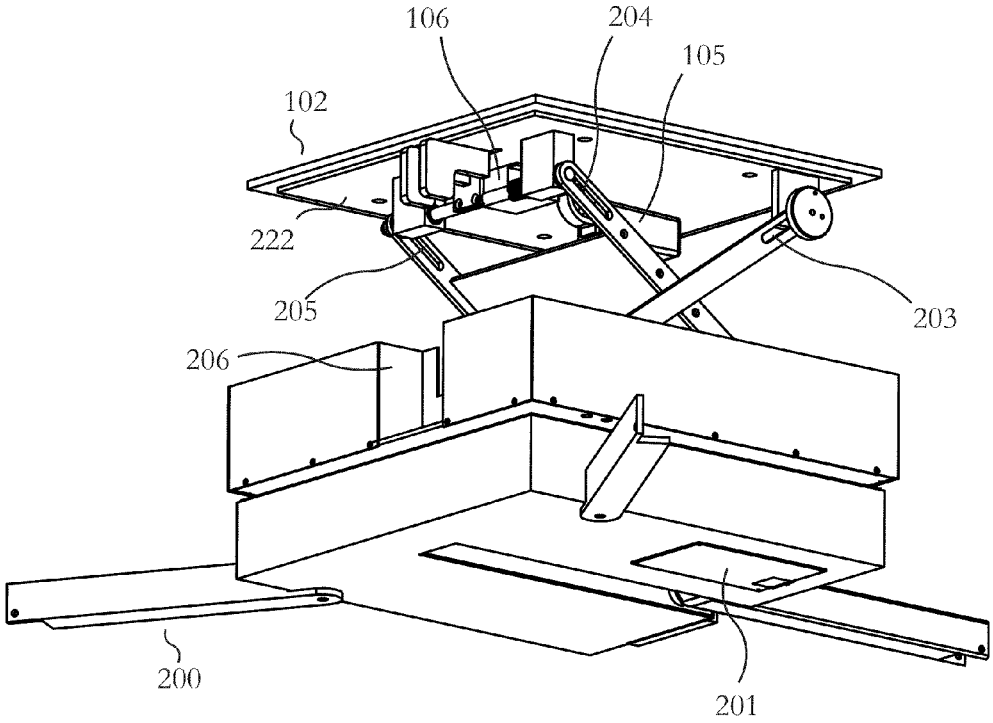
FIG. 2 shows a bottom perspective view of an embodiment of the invention in the deployed position.

Collapsible antenna positioner 103 is further described below and in FIG. 4. The collapsible antenna positioner allows for altering the elevation of antenna 102 mounted on antenna mounting plate 222 (as shown in FIG. 2). Beneath antenna mounting plate 222 lies waveguide 104 and LNB 105. Tilt sensor and magnetometer 106 is also coupled with the bottom of antenna mounting plate 222. Tilt sensor and magnetometer 106 is used in order to measure the angle that antenna mounting plate 222 is pointing and determine the direction of North. Pinch paddles 107 and 108, release knobs 112 and 113 are used in order to disengage the positioning arms from antenna mounting plate 222 and elevation motor as will be explained in relation to FIG. 4. Any method of disengagement may be substituted with regards to pinch paddles 107 and 108 and release knobs 112 and 113.

FIG. 2 shows a bottom perspective view of an embodiment of the invention in the deployed position. Stabilizer leg 200 is visible in this figure. The deployment of stabilizer leg 200 is optional as well as is the deployment of stabilizer leg 117 and adjustable leg 115 as shown in FIG. 1. Optional battery compartment 201 allows for battery removal and replacement without disturbing the internal components of positioner base 100. Pinch paddle port 206 allows for operation of the pinch paddles when the apparatus is in the collapsed position. Collapse grooves 203, 204 and 205 allow for the collapsing of collapsible antenna positioner 103 as shown in FIG. 1 by allowing for the disengaging of the respective axles in the associated positioning arms as will be further described in relation for FIG. 4.

Figure 3:
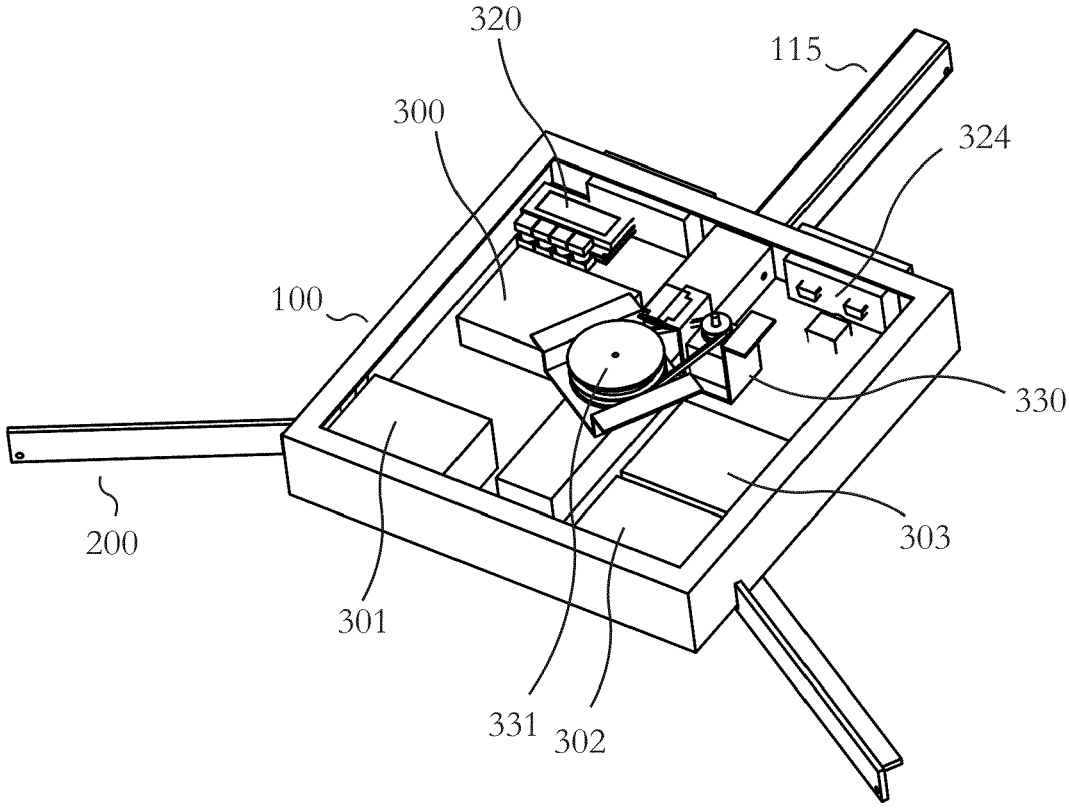
FIG. 3 shows a perspective view of an embodiment of the positioner base with cover removed to expose internal elements.

FIG. 3 shows a perspective view of an embodiment of the positioner base with cover removed to expose internal elements. Normally, positioner base 100 is closed to the external elements so that dust and water are not able to readily enter the apparatus. Microcontroller 300 hosts the control program which reads inputs from keypad 320 and commands azimuth motor 330 to rotate via motor controller 303 to a desired azimuth based on various inputs. Optional motor controller 302 may run the elevation motor in the positioner support frame, or motor controller 303 may comprise a two port motor controller capable of running both motors independently. GPS receiver 324 provides time and position information to microcontroller 300. Drive hub 331 rotates positioner support frame 101 in order to point antenna 102 mounted to antenna mounting plate 222 in the desired azimuth. Optional location for battery 301 may be as shown in FIG. 3, or as was shown in FIG. 2 may lie between motor controller 303 and GPS receiver 324. Optionally, if motor controller 303 comprises two independent ports, then motor controller 302 may be replaced by an optional wireless transceiver to eliminate the need to physically connect to a PC. Any other unused space within positioner base 100 may also be used for external communications such as wireless transceivers.

Figure 4:
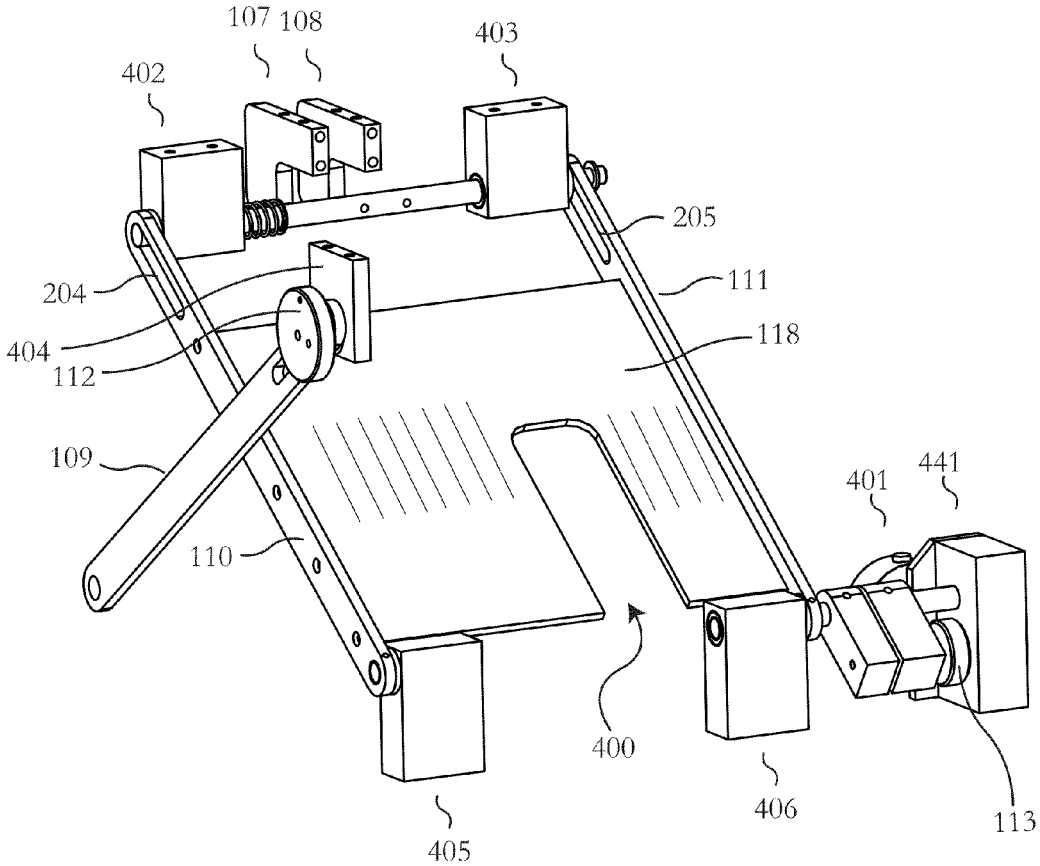
FIG. 4 shows a perspective view of an embodiment of the collapsible antenna positioner.

FIG. 4 shows a close up of collapsible antenna positioner 103 as is partially shown in FIGS. 1 and 2. Plate mounts 402, 403 and 404 act to couple antenna mounting plate 222 as shown in FIGS. 1 and 2 to positioner arms 110, 111 and 109 respectively. Positioner arms 109 and 110 are not directly coupled to one another. Pinch paddles 107 and 108 act to disengage positioner arms 110 and 111 from associated antenna mounting plate 222 in order to collapse the apparatus. When pinch paddles 107 and 108 are forced together, the common axle is disengaged and slides freely along collapse grooves 204 and 205. Similarly, when release knob 112 is activated, positioner arm 109 is disengaged from the axle associated with release know 112 allowing the axle to freely slide along collapse groove 203 as shown in FIG. 2. When motor release knob 113 is activated, elevation motor 401 and hence worm drive 441 are disengaged from positioner arm 111 allowing the apparatus to fully collapse.

Stiffness in collapsible antenna positioner 103 as shown in FIG. 1 is added via positioner arm plate 118. LNB cutout 400 provides space for LNB 105 when antenna mounting plate 222 collapses in to positioner support frame 101. Frame mounts 405 and 406 provide rotational mounts for positioner arms 110 and 111. Positioner arm 109 couples to another frame mount that is not shown for ease of illustration.

Figure 5:
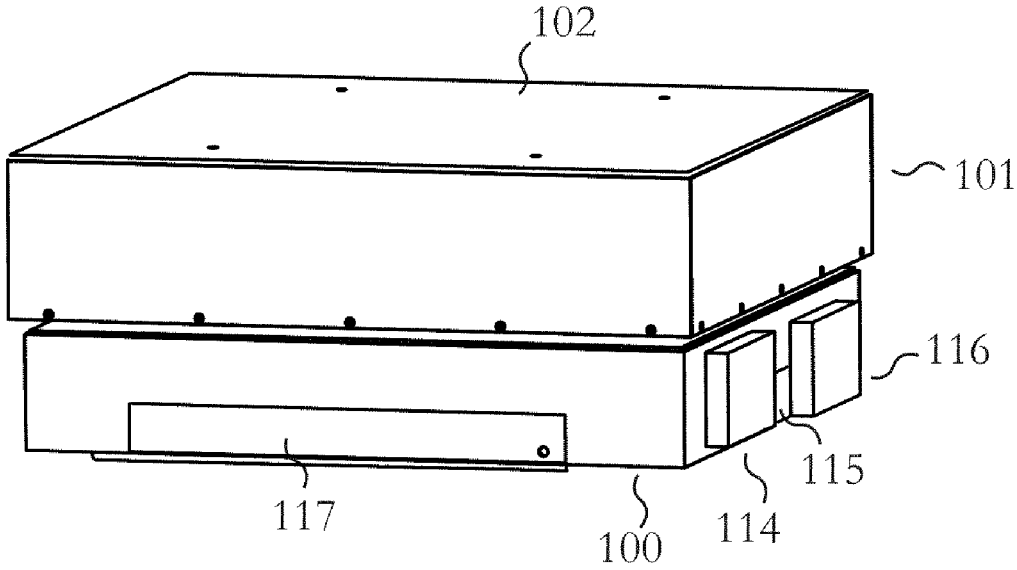
FIG. 5 shows a perspective view of an embodiment of the invention in the collapsed position.

FIG. 5 shows a perspective view of an embodiment of the invention in the collapsed position. Adjustable leg 115 is folded underneath positioner base 100. Stabilizer leg 117 is folded against the side of positioner base 100. Antenna mounting plate 222 is shown collapsed into positioner support frame 101. The apparatus as shown in FIG. 5 is ready for shipment.

Operation of embodiments of the invention comprise initial physical setup and powered acquisition of a desired satellite. Initial physical setup may comprise extending one or both of stabilizer legs 117 and 200 and in addition, optionally unfolding adjustable leg 115. As adjustable leg 115 may optionally comprise a powered stepper motor for altering the elevation of the apparatus when a satellite is near the zenith to eliminate keyholing. Alternatively, adjustable leg 115 may be manually adjusted. After any desired legs are deployed, pinch paddles 107 and 108 may be asserted in order to extend the associated axle up into the locked position on positioner arms 110 and 111. The opposing side of antenna 102 may then be lifted in order to lock the axle associated with release knob 112 in the extended position in positioner arm 109. When the axle associated with release knob 112 travels the full length of collapse groove 203, release knob 112 is in the locked position and must be asserted in order to release the associated axle and collapse the apparatus. With opposing sides of antenna 102 locked into position, motor release knob 113 is asserted in order to engage worm drive 441 and hence elevation motor 401. For connection based configurations not employing wireless communications, connecting desired communications links to a PC or other communications processor is performed. For configurations dependent upon an external computer, microcontroller 300 is optional so long as motor controller 303 comprises a communications port. As long as the external PC comprises the requisite drivers and satellite orbit calculation programs it may be substituted for microcontroller 300.

After physically deploying the apparatus, keypad port 116 may be accessed in order to operate keypad 320. Operations accessible from keypad 320 comprise acquire, stop, stow and test.

Asserting the acquire button and selecting a satellite initiates an orbital calculation that determines the location of a satellite for the time acquired via the GPS receiver. With the latitude and longitude acquired via GPS receiver 324 and the direction North and tilt of the apparatus measured via tilt sensor and magnetometer 106 all of the parameters required to point antenna 102 towards a desired satellite may be achieved. Positioner support frame 101 is rotated to the desired azimuth via drive hub 331, azimuth motor 330 and motor controller 303. Antenna 102 is elevated to the desired elevation via antenna mounting plate 222, plate mounts 402, 403 and 404, positioner arms 110, 111 and 109, worm drive 441 and elevation motor 401. Communications and control lines, not shown for ease of illustration, extend through a center hole in drive hub 331 to and from positioner base 100 and positioner support frame 101. These communications and control lines allow for the control of elevation motor 401 and receipt of down converted satellite signal via LNB 105 and measurement data from tilt sensor and magnetometer 106. For satellite locations near the zenith in the reference frame of the apparatus, an optional stepper motor at the end of adjustable leg 115 may be activated in order to shift the observed zenith of the apparatus away from the desired satellite near the observed zenith in order to prevent keyholing.

Asserting the stop button on keypad 320 stop whatever task the apparatus is currently performing. This button can be activated prior to activating the stow button. The stow button realigns positioner support frame 101 with positioner base 100 and performs a system shutdown. The test button performs internal system tests and may be activated with or without collapsible antenna positioner 103 deployed. These operations may be modified in certain embodiments or performed remotely by an attached PC or over a wireless network in other embodiments.

Figure 6:
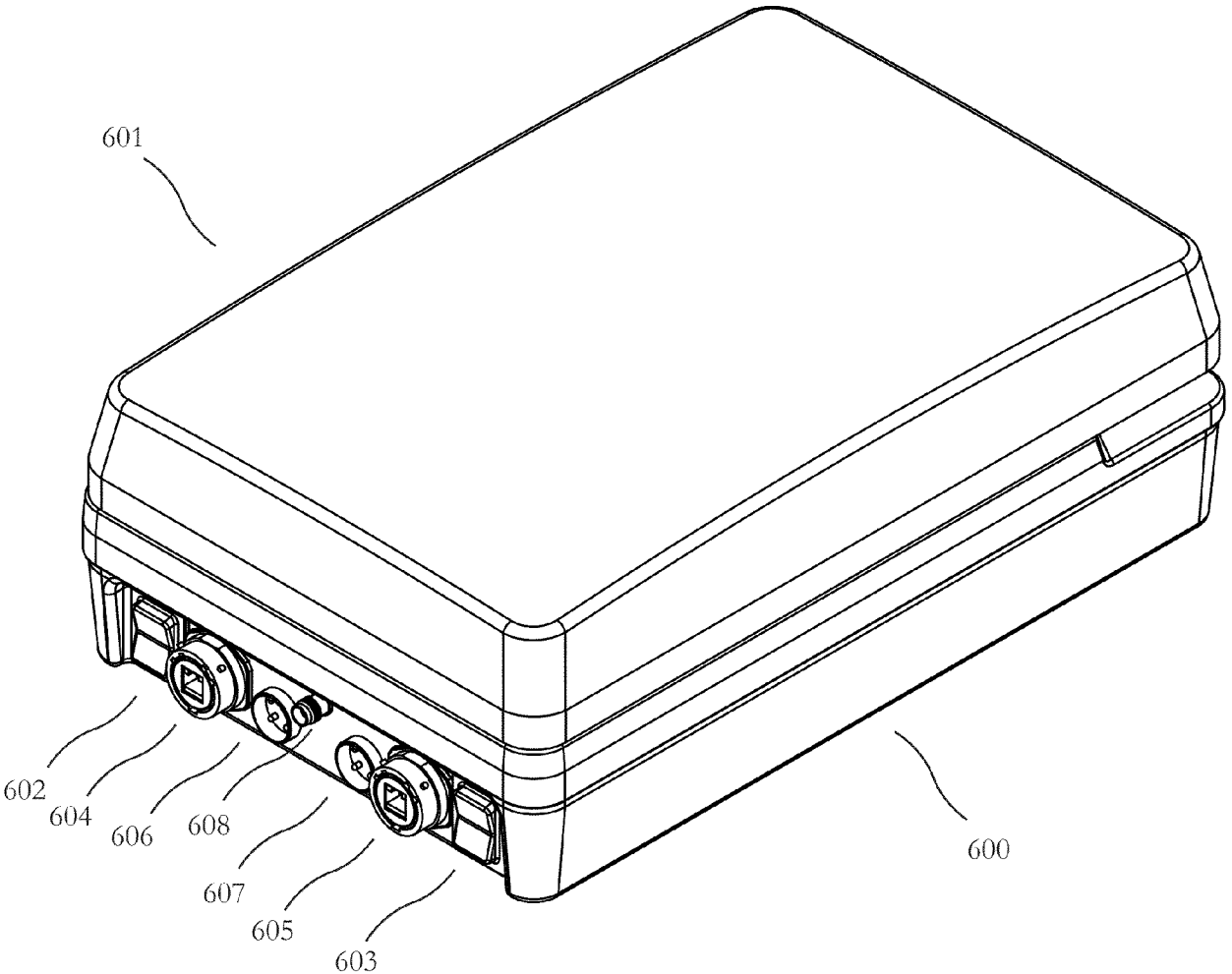
FIG. 6 shows an isometric view of an embodiment of the invention in the stowed position.

FIG. 6 shows an isometric view of an embodiment of the invention in the stowed position. Positioner base 600 houses electronic components and mates with antenna housing 601 for compact storage. Positioner base 600 provides access to power switch 602, remote computer Ethernet connector 604, power plug A 606, power plug B 607, LNB RF out 608, data Ethernet connector 605 and day/night/test switch 603. Power plug A 606 and power plug B 607 are utilized for coupling with power sources, batteries and solar panels for embodiments without built in receivers. Data Ethernet connector 605 provides internal receiver data for embodiments comprising at least one built in receiver which allows for coupling with external network devices capable of consuming a satellite data stream. In addition, one or more embodiments of the invention may use data Ethernet connector 605 for providing the apparatus with transmission data for transmission to a desired satellite. Day/night/test switch 603 is utilized in order to set the display (shown in FIGS. 8-10) to provide for day and night time visual needs while the third position is utilized in order to test the system without deploying antenna housing 601.

Figure 7:
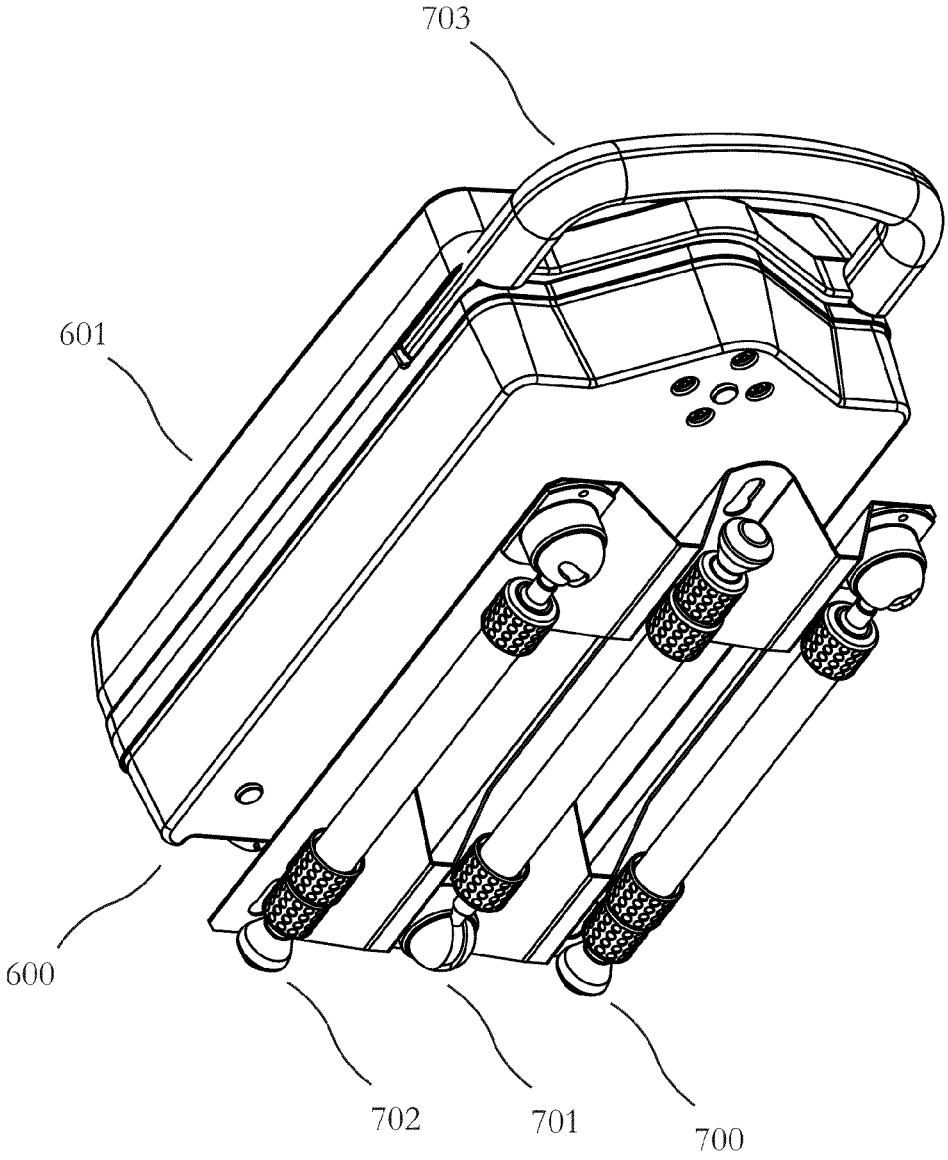
FIG. 7 shows an isometric view of the bottom of an embodiment of the invention in the stowed position.

FIG. 7 shows an isometric view of the bottom of an embodiment of the invention in the stowed position. Carrying handle 703 may be used to physically move the apparatus. Legs 700, 701 and 702 may form a removable leg system as shown or may independently be mounted to the bottom of positioner base 600. In addition, a stackable module may be coupled to positioner base 600 in order to provide cryptographic, power/battery, router or any other functionality to augment the capabilities of the apparatus.

Figure 8:
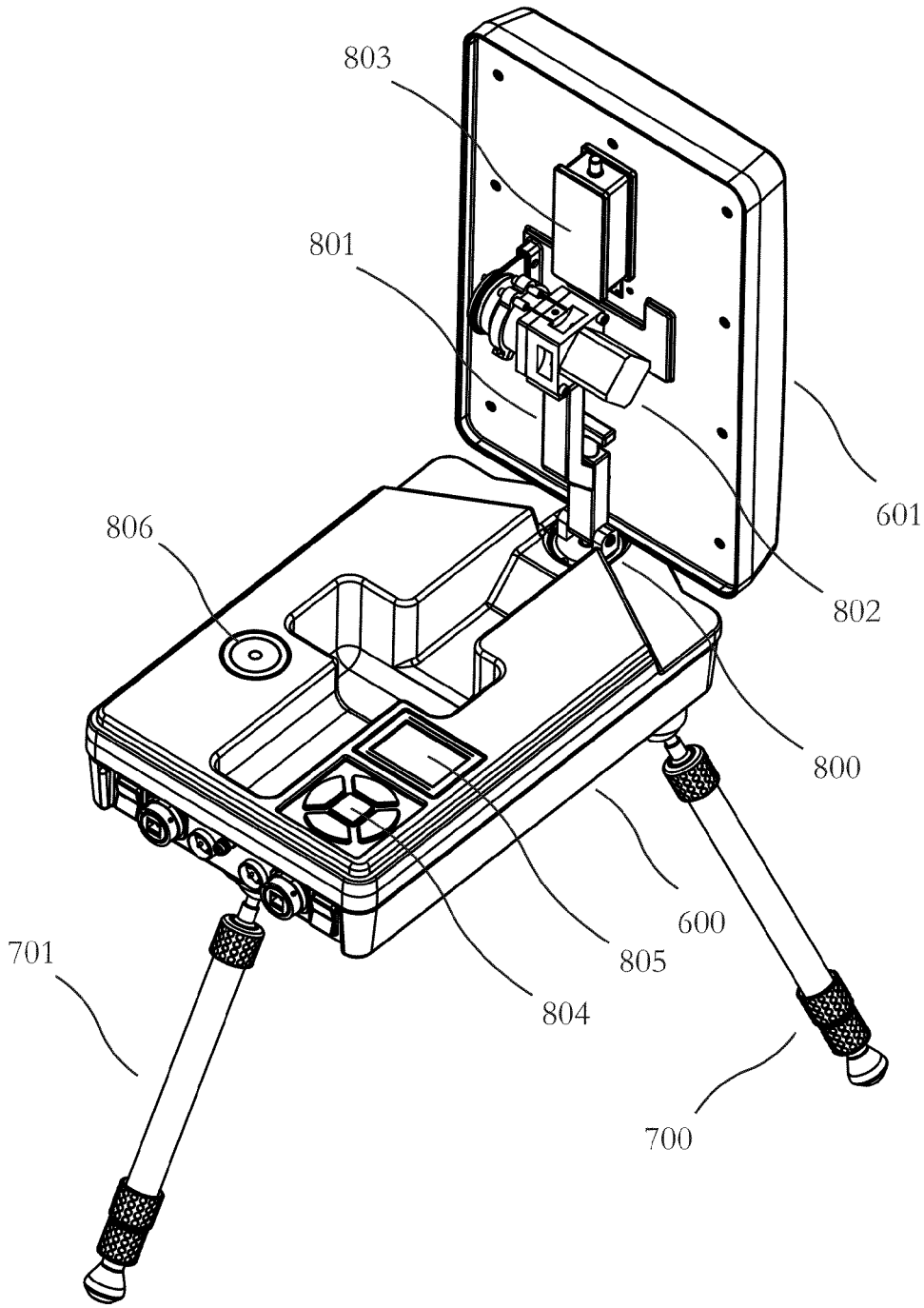
FIG. 8 shows an isometric view of an embodiment of the invention in the deployed position.

FIG. 8 shows an isometric view of an embodiment of the invention in the deployed position. Legs 700 and 701 are shown in the deployed position. Bubble level 806 is used to level positioner base 600 in combination with the legs or by placing objects underneath an embodiment of the invention not comprising legs until positioner base 600 is roughly level. The system has no loose parts and requires no tools. Since there are no parts to loose, the system is more robust. The system may include a camouflage bag that encapsulates the system and may be changed from desert to jungle to urban camouflage or black. Many different types of legs may be employed on the system depending on the terrain that the system is to be used in, including but not limited to legs with rubber bottoms, spikes or any other type of bottom, and the legs themselves may be of any type including telescoping or rigid or any other type. Keypad 804 and display 805 are utilized in order to control the apparatus. Also shown is azimuth motor 800 that rotates positioning arm 801 and elevation motor 802 which rotates antenna housing 601 in elevation. In one or more embodiments, antenna housing 601 may be rotated on an axis orthogonal to the plane of antenna housing 601 and may optionally include a third motor, however low power embodiments of the invention allow for the operator of the system to manually rotate antenna housing 601 for linear polarized satellite signals. LNB 803 couples with the reverse side of the antenna that is located within antenna housing 601. When opening one embodiment of the invention, positioning arm 801 locks into a vertical position as shown and after selecting a satellite to acquire an internal or external microcontroller rotates azimuth motor 800 and elevation motor 802 based on the GPS position, time and compass orientation of the apparatus. One embodiment of the invention may provide a limited turning range for azimuth motor 800 for example 60 degrees, in order to limit the overall weight of the device by allowing for simpler cable routing and minimizing complexity of the mechanism. Positioner base 600 comprises an indentation shown in the middle of positioner base 600 for housing positioning arm 801, elevation motor 802 and LNB 803 when in the stowed position. The indentation may make use of a hole that allows for environmental elements such as water, dirt, mud, snow or any other objects to drain or fall through the indentation. In addition, the hole may be coupled to the electronic components in order to provide a thermal well for heat management purposes. (See FIG. 12). In one or more embodiments, thermal bonding of the electronic components to the upper and lower portions of the positioner base does not comprise a hole. Electronic components internal to positioner base 600 may comprise a microcontroller or computer which hosts a control program which reads inputs from keypad 804 and commands azimuth motor 800 to rotate to a desired azimuth. Positioner base 600 may also comprise a GPS receiver that provides time and position information to the microcontroller. Positioner base 600 and antenna housing 601 may comprise a three axis accelerometer or inclinometer, magnetometer, data receiver and relative signal strength indicator (RSSI) receiver and reports to the microcomputer the signal strength of the signal received and that information is used for the accurate pointing of the antenna.

Using keypad 804, embodiments of the invention may utilize a "one button" or "no button setup" procedure. After opening the system and deploying the antenna in antenna housing 601 and turning the power on, the system determines where it is and if pointed within a general direction of a satellite, requires no button pushes for the system to lock. The system can also perform the no button option so that after power loss and restore, the system re-acquires a satellite. This may occur with no intervention. One button operation may be utilized when the system is not rotated close enough to a satellite for example, where the system may prompt the user to rotate positioner base 600 in one direction or the other and assert the acquire button. The prompt may include an "X" to the left or right in display 805 (for example an LED screen) to let the user know to turn positioner base 600 clockwise or counterclockwise for example. Display 600 may also present auto satellite options. For example, the first choice and second choice satellites may be presented to the user based on the band the system is configured for. Based on the location of the antenna on the planet, the user interface shows the operator the most likely satellite that is normally picked.

With regards to saving power and minimizing heat dissipation, algorithms may be employed by the computer housed in positioner base 600, that conserve power may be utilized in one or more embodiments of the invention.

Low power embodiments of the invention employ a limited range of motion in azimuth (e.g., azimuth motor 800 rotates only a portion of 360 degrees) for the antenna positioner which allows the operator to be presented with an "X" in a box of the user interface is display 805. The operator sets the system to point within 60 degrees of a satellite, not 360 degrees. The system then prompts the user with the "X" which is on the left of the box if the operator should rotate the positioner base to the left and the "X" appears on the right side of the box if the operator is to rotate the positioner base to the right. Once the positioner base is within 30 degrees, the operator asserts a button and the system begins to acquire a satellite. Wiring of the system is simplified by sub-360 degree rotation and weight is lowered as well.

The search algorithm utilized by the system may be optimized to search in azimuth and sparsely search in elevation. This is due to the fact that magnetic anomalies are more prevalent than gravitational anomalies. The system looks first in azimuth before elevation (preferential azimuth searching) since that is where the errors are likely found. For example in one embodiment, the search proceeds to do two horizontal scan lines first above the initial point before performing two horizontal scan lines below the initial point. In other words, after the signal peaks, it goes to peak then leaves the raster scan algorithm then uses a box peaking algorithm right and up to a corner, go to a left corner, down to corner and right bottom corner, e.g., 5 measurements. Then the system points to the strongest and does the four corner measurements again.

When the four corners of the box have equal strength the antenna is positioned correctly and the search algorithm terminates.

In order to further save power, one or more embodiment may allow for the computer to perform tracking at uneven time intervals. For example, when tracking a geosynchronous satellite, e.g., one that move in a figure eight pattern but remains relatively in one general area of the sky, the system can stop tracking the satellite at the top and bottom of the figure eight since motion is relatively slow there. The system can switch to more rapid tracking when the satellite is scheduled to move from the upper to the lower portion of the figure eight since the satellite motion is fast during this period. Conserving power as determined by two-line element (TLE) determined re-peak schedule allows for lower power dissipation and longer battery life. The system may utilize distributed I2C thermal sensors. The sensors may be placed on the electronics boards utilized by the system for example, so the computer can self-monitor the components.

In another power saving embodiment, the computer housed in positioner base 600 performs tracking of the satellites in a manner that may switch between transponder signal and the beacon tracking signal output by a satellite. For example, beacons have a different frequency and are lower power than the data signal of the satellite. The beacons are also omni-directional so the system can find the satellite even if it is not pointed at the system at the time of acquisition. For small low power antennas, the beacon may be to small to detect, so if the data signal via the satellite transponder is on, it can be used to find and lock onto the satellite even if the beacon is too weak to detect.

In order to further save power and time in acquiring satellites, the age of the two line (TLEs) is taken into account in one or more embodiments of the invention by the computer housed in positioner base 600. This is known as Clarke Belt Fallback. For ephemeris data or two line elements (TLEs as used by Nasa), fresh TLE data allows the system to point to the satellite accurately. However, in a couple of weeks, the TLE information is out of date, in a couple of months is actually quite inaccurate. For perfectly stationary satellites on the Clarke belt, i.e., equator, all the system has to know is the longitude to find one of these satellites. The satellites that move have a problem in that a fresh TLE is more accurate than a Clarke Belt longitude, but after 30 days the system falls back to the Clarke Belt longitude since it is more accurate after about this time span. Without fresh TLEs, acquisition takes more time and power, but by using the Clarke Belt Fallback, the system can still function.

Figure 9:
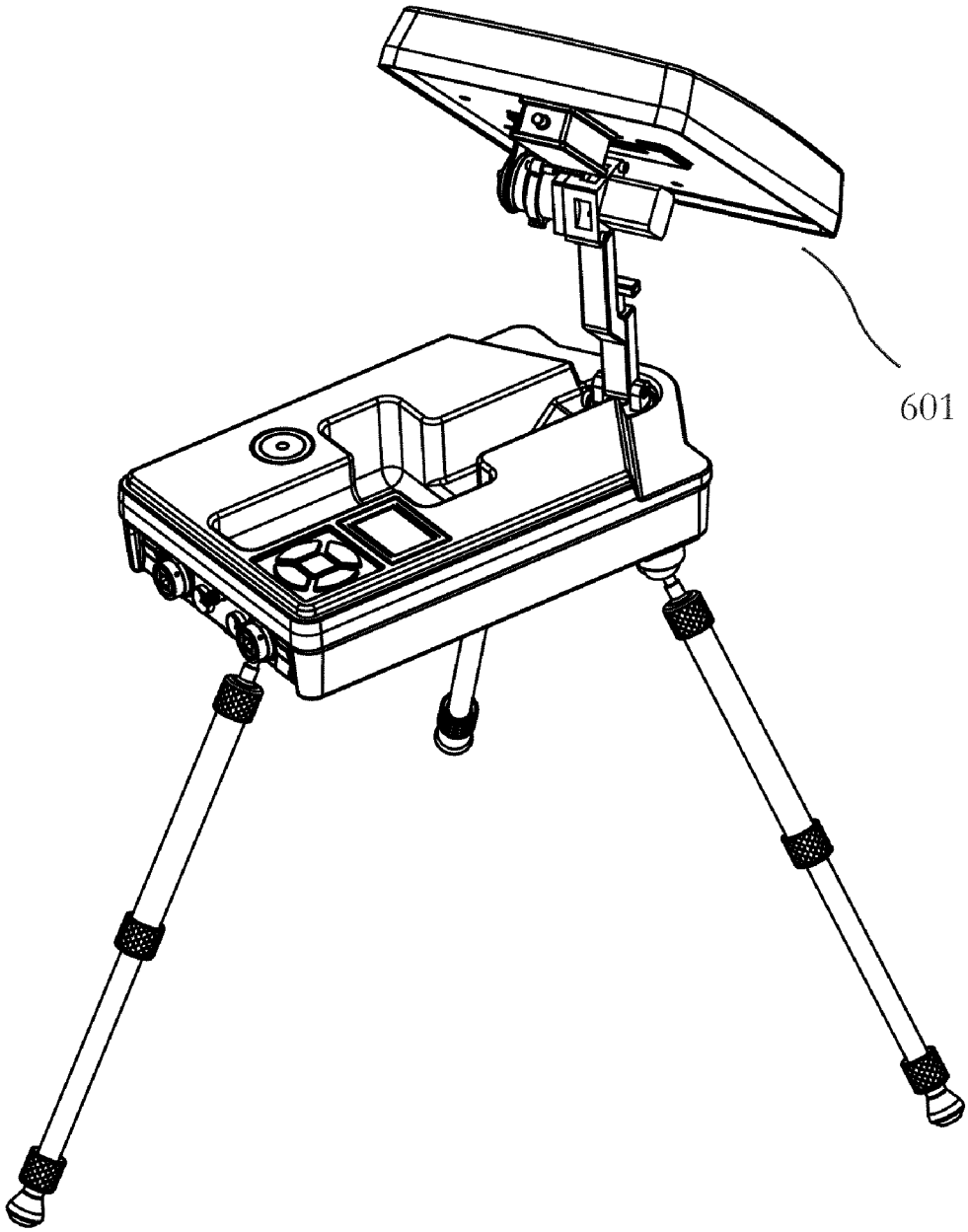
FIG. 9 shows an isometric view of an embodiment of the invention with the antenna housing at a first azimuth and elevation setting.
Figure 10:
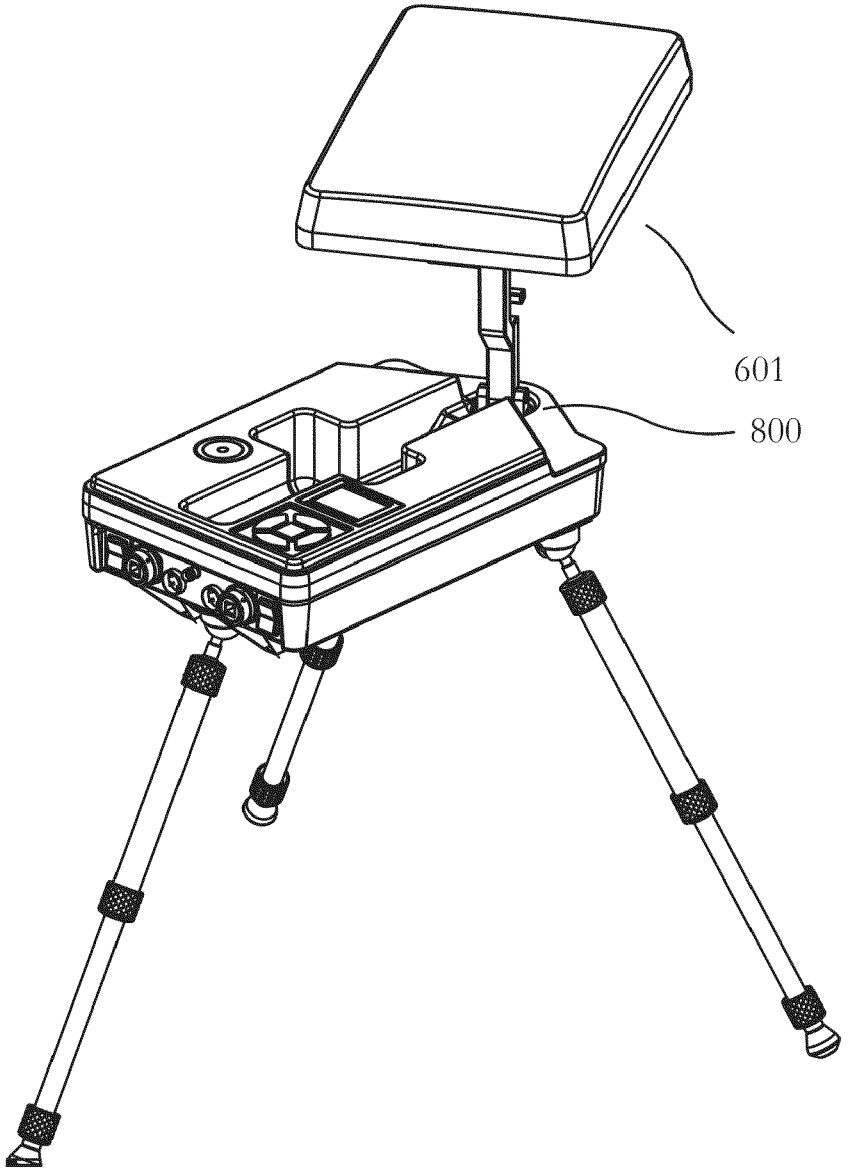
FIG. 10 shows an isometric view of an embodiment of the invention with the antenna housing at a second azimuth and elevation setting.

FIG. 9 shows an isometric view of an embodiment of the invention with the antenna housing at a first azimuth and elevation setting. Antenna housing 601 in this figure is pointed at a satellite midway between the zenith and horizon. FIG. 10 shows an isometric view of an embodiment of the invention with the antenna housing at a second azimuth and elevation setting wherein the satellite is directly above the apparatus at the zenith. One or more embodiments of the control program may search for a desired satellite by scanning along the azimuth as the elevation of the apparatus is generally fairly accurate and wherein the local magnetometer may give readings that are subject to magnetic sources that influence the magnetic field local to the apparatus.

Some embodiments of the invention allow for a quick disconnect for the antenna panel or antenna itself in antenna housing 601. This allows for different satellites having entirely different frequency bands to be acquired with the system. This quick disconnect capability may be implemented by using double pins to hook the antenna or antenna housing 601 to positioning arm 801. By releasing one antenna and attaching another antenna to the positioning arm, a different set of satellites in general may be acquired since some satellites use various frequencies. Linearly polarized satellites, generally commercial satellites may be acquired using a third rotational motor that allows for the antenna to rotate about the axis pointing at a satellite. For low power configurations, this allows for the user to be prompted to rotate the antenna until the strength of the signal is maximized. Low power embodiments therefore do not require a third axis motor.

The system may also employ a failure contingency tree that is utilized by the computer housed in positioner base 600. For example if any portion of the system fails, the system may prompt the user via the display and allow the user to utilize the keypad 804 an attached keyboard to respond to system requests for positioning the system, etc. For example, if the GPS or tilt fails, the system allows the operator to compensate for the error, prompts for entry on keyboard, of the GPS position or to acknowledge that the base is level. In short, the system is configured to ask the user for help is components break.

The system may employ tilt compensation via the computer housed in positioner base 600 so that even if positioner base 600 is not level, the scan includes adjustment to elevation motor 802 so that the scan lines are parallel to the horizon as azimuth motor 800 turns so that the scan lines are not parallel to the incline on which the positioner base is situated. The three-axis accelerometer is used to provide tilt measurements in one or more embodiments of the invention.

The system also is capable of manually-assisted linear polarization setting. When aligning the third axis, that is aligning the antenna in antenna housing 601 about an axis orthogonal to the antenna plane for linear polarization, the operator may be prompted for rotating the antenna manually via display 805. This allows for the elimination of a third motor although this motor is optional and may be employed in embodiments that are not power sensitive. The linear polarization axis is the least critical of all of the axial settings, so a little error is acceptable. In addition, the system without a linear polarization axis motor is lower weight. An embodiment using a third axis motor for linear polarization may be manually moved if the motor controller for the linear polarization axis is detected as not working.

The system may also be configured for bump detection and reacquisition via the computer housed in positioner base 600. In this configuration, the system detects when the base or the antenna is bumped and reacquires the satellite. If the satellite signal is still high, then the system returns to a four corner boxing algorithm for example, otherwise the system goes back into half-scan mode where only half the elevation scan lines are checked while checking range of azimuth. With two three-axis accelerometers, one on positioner base 600 and one in antenna housing 601 or coupled with the antenna in antenna housing 601, both may be used for bump detection.

One or more embodiments of the invention allow for a sensor built into changeable antenna or changeable antenna housing 601. For example, a three-axis accelerometer may be built into the changeable antenna or changeable antenna housing 601. In addition, the antenna/housing may be configured with memory in the changeable antenna that is used to notify the system what band the antenna is, so the system does not have to perform third axis rotation when not acquiring a satellite that uses linear polarization. For example, if acquiring a Ka band military satellite, the antenna panel is read and based on the fact that the Ka band antenna is being utilized, a whole set of the correct satellites in the correct band may be presented to the user via display 805 wherein some of all of the previous satellites receivable with the previous antenna are no longer presented. An additional tilt sensor may be utilized in the positioner base for crosschecking with antenna. Any redundant positioners may be placed throughout the system in order to provide redundancy and crosschecking capabilities.

The system allows for updating TLEs over the data link acquired. This allows for fresh TLEs to be used in locating and tracking satellites. The broadcasters may be configured to send down TLEs that the system uses to automatically update the local TLEs. After one month, the TLEs are considered old and if the system is powered up, then it may automatically update the TLEs if the acquired satellite is configured to broadcast them. The download of ephemeris data or TLEs may occur before or after two months, or at any time that is convenient as determined by computer house in positioner base 600 or by the operator of the system for example.

One or more embodiments of the invention provide an Integrated Receiver Decoder (IRD) slot in positioner base 600. An IRD allows for set-top box functionality and may provide channel guide type functionality. The user interface to the IRD may include an IRD lock function that allows for feedback to the user for tracking qualification. If the IRD is integrated into the positioner base, the IRD can provide input to the positioner's computer or a visual display to the user to qualify the satellite as being identified as the desired satellite. In one small area of the sky, there may be five 5 commercial satellites in the field of view, so the system may prompt the user to select Next Satellite to continue looking for the correct satellite via display 805 or the computer may automatically look to the next satellite.

After physically deploying the apparatus, keypad 804 as shown in FIG. 8 may be utilized in order to operate the apparatus. Operations accessible from keypad 804 comprise acquire, stop, stow and test and may also include functions for receiving meta data regarding a channel for example a program information such as an electronic program guide for a channel or multiple channels. Data received by the apparatus may comprise weather data, data files, real-time video feeds or any other type of data. Data may also include TLEs so that the position information of the satellites is updated. Data may be received on command or programmed for receipt at a later time based on the program information metadata. Keypad 804 may also comprise buttons or functions that are accessed via buttons or other elements for recording a particular channel, for controlling a transmission, for updating ephemeris or TLE data or for password entry, for searching utilizing an azimuth scan or for searching for any satellite within an area to better locate a desired satellite. Any other control function that may be activated via keypad 804 may be executed by an onboard or external computer in order to control or receive or send data via the apparatus.

Asserting the acquire button and selecting a satellite initiates an orbital calculation that determines the location of a satellite for the time acquired via the GPS receiver. With the latitude and longitude acquired via GPS receiver and the direction North and tilt of the apparatus measured via tilt sensor and magnetometer all of the parameters required to point the antenna towards a desired satellite are achieved. Antenna housing 601 is rotated to the desired azimuth via azimuth motor 800. The antenna in antenna housing 601 is elevated to the desired elevation via elevation motor 802. The internal RSSI receiver may also be used in order to optimize the direction that the antenna is pointing to maximize the signal strength.

Asserting the stop button on keypad 804 stops whatever task the apparatus is currently performing. This button can be activated prior to activating the stow button. The stow button realigns positioner arm 801 with positioner base 600 and performs a system shutdown. The test button performs internal system tests and may be activated with or without antenna housing 601 deployed. These operations may be modified in certain embodiments or performed remotely by an attached PC or over a wireless network in other embodiments.

Figure 11:
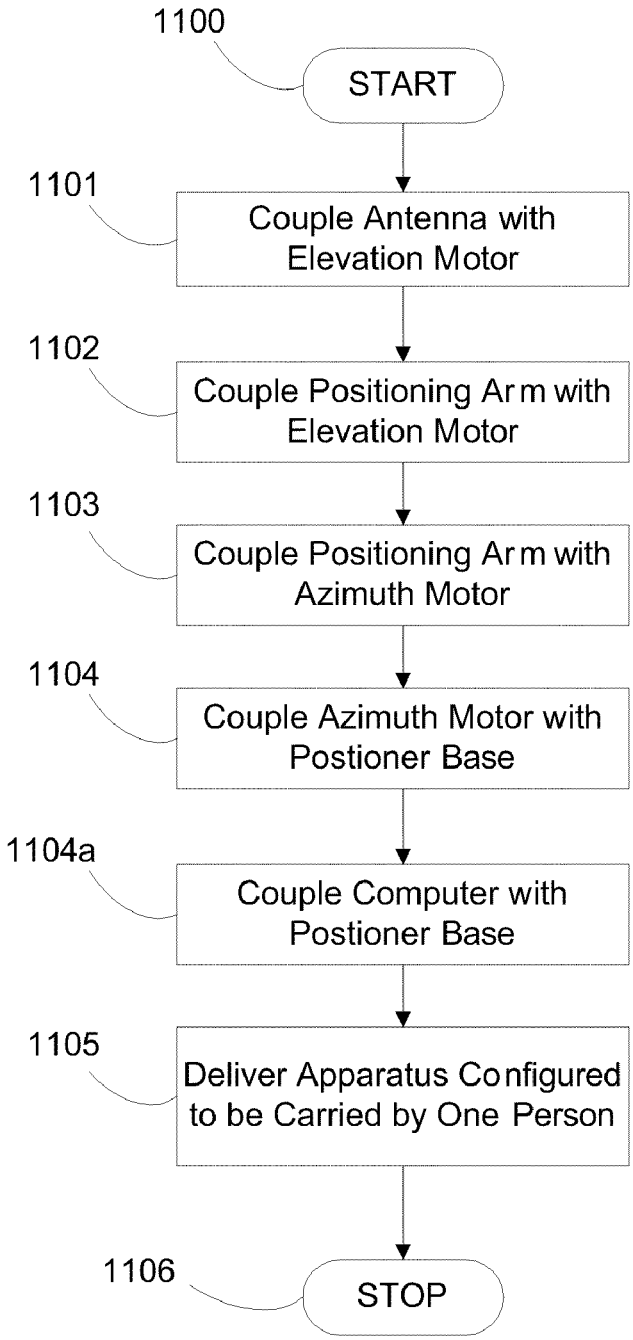
FIG. 11 shows a flowchart depicting the manufacture of one or more embodiments of the invention.

FIG. 11 shows a flowchart depicting the manufacture of one or more embodiments of the invention which starts at 1100 and comprises coupling an antenna with an elevation motor at 1101. Optionally a cover or antenna housing may be coupled with the antenna (not shown in FIG. 11 for ease of illustration). At least one positioning arm is then coupled with the elevation motor at 1102. The positioning arm is further coupled with an azimuth motor at 1103. The azimuth motor is then coupled with a positioner base at 1104. The computer is coupled with the positioner base at 1104*a*. The computer is configured for searching, tracking, bump detection and other functionality when coupled to positioner base, or before or after coupling with positioner base. The positioner base may comprise a hole for allowing environmental elements to fall or leak through the potential well created by the indentation in the base that houses the positioner arm when the antenna housing is closed against the positioner base. The positioner base may optionally comprise a configuration that limits the amount of azimuth travel in order to allow for a smaller or more compact azimuth motor and to cut total weight from the system. The apparatus is delivered to an individual in a configuration that allows for a single person to carry the apparatus at 1105 wherein the manufacture is complete at 1106.

Figure 12:
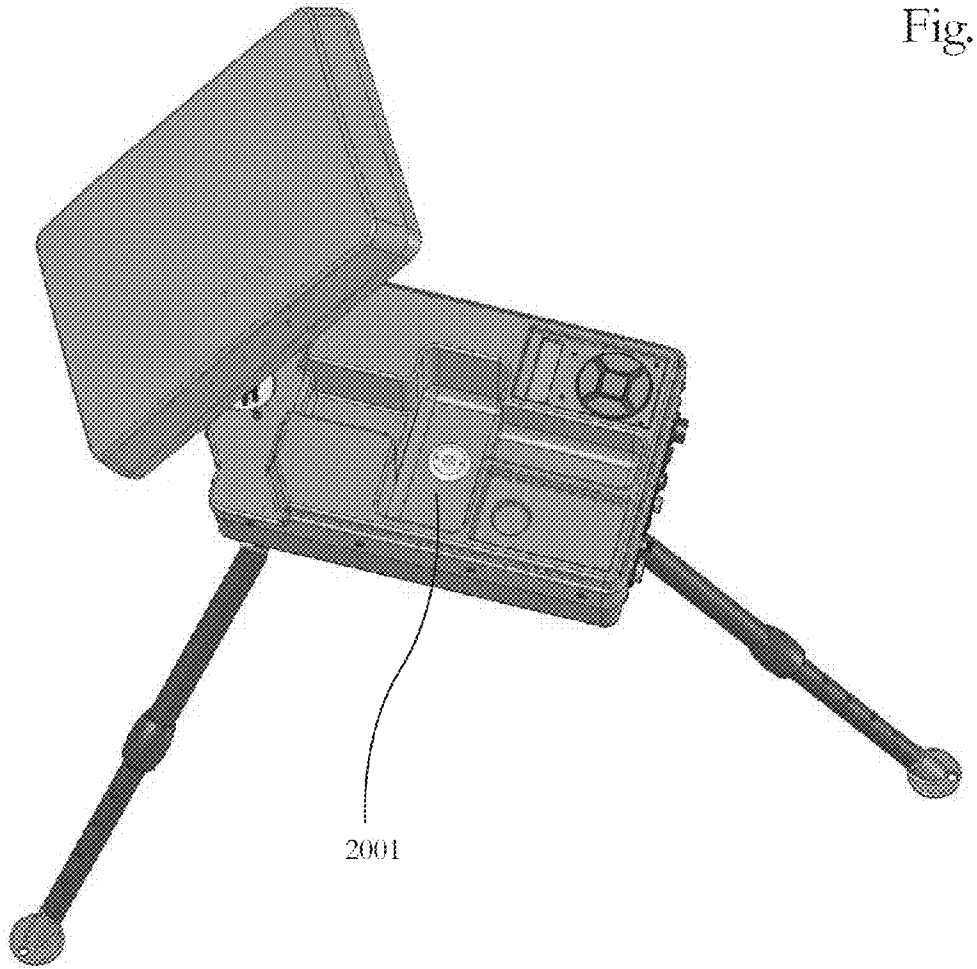
FIG. 12 shows an embodiment of the position base configured with a hole to allow for environmental elements to escape and to also manage heat dissipation of the system.
Figure 13:
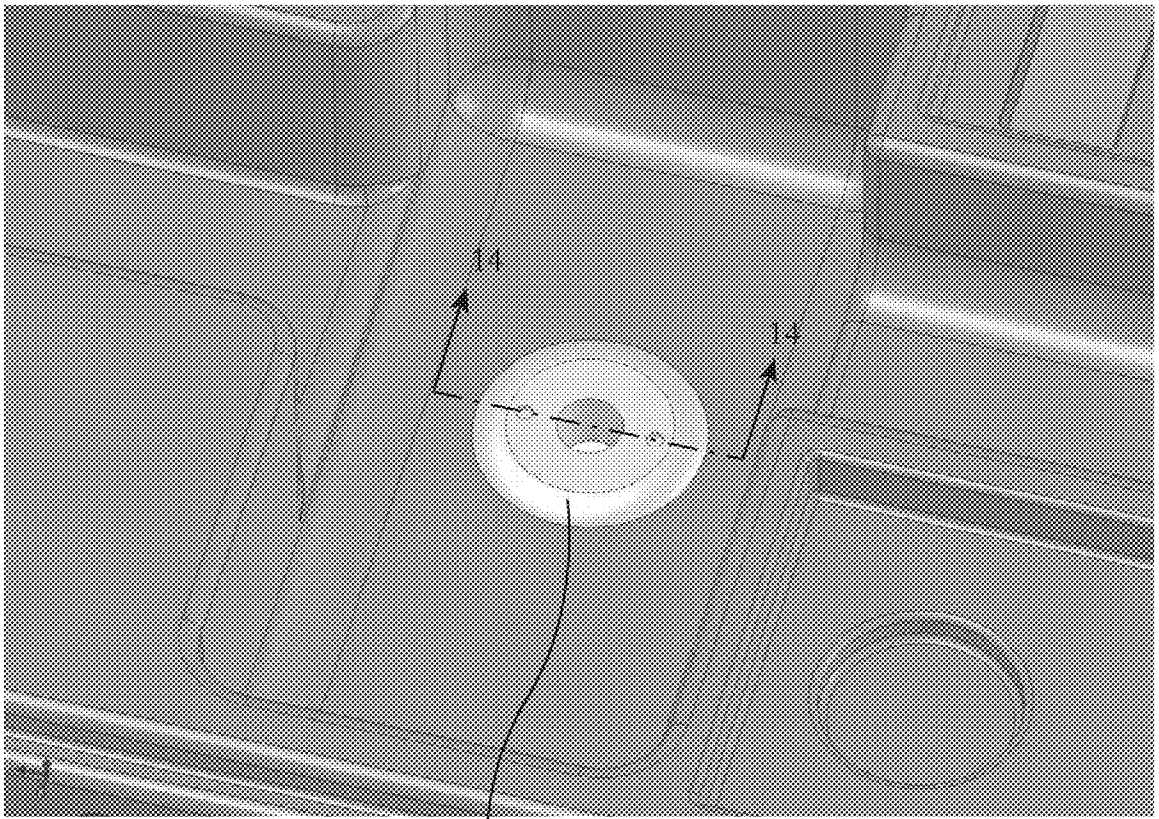
FIG. 13 shows a close-up of FIG. 12.
Figure 14:
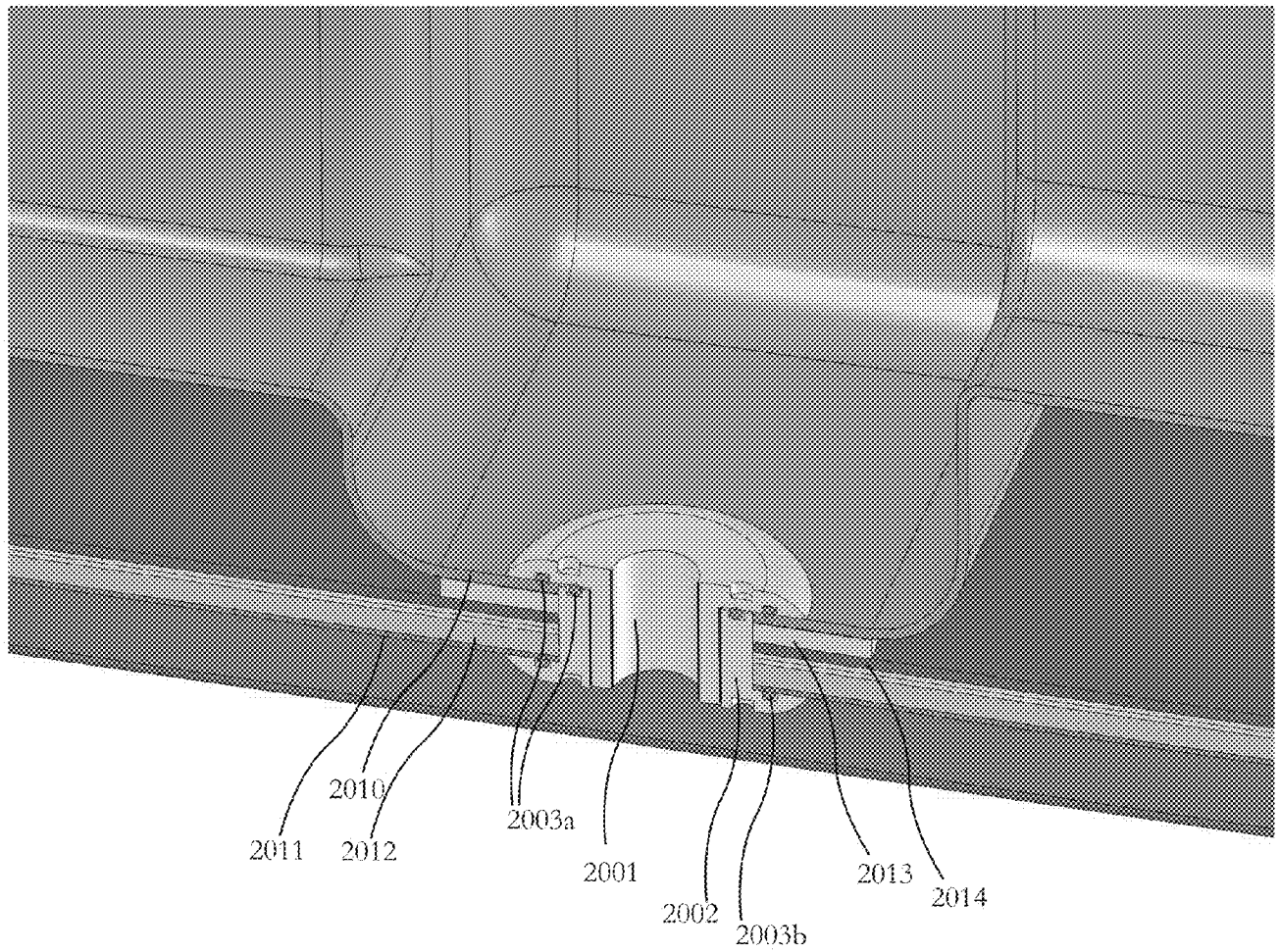
FIG. 14 shows a cross sectional view of FIG. 12.

FIG. 12 shows an embodiment of the position base configured with a hole to allow for environmental elements to escape and to also manage heat dissipation of the system. The thermally conductive elements do not require use of a hole and the hole is optional in one or more embodiments of the invention. Embodiments of the positioner base may make use of a hole in the base such that water and other environmental elements do not collect in the potential well in the positioner base where the antenna positioning elements are stored. In this embodiment, a thermal well may be employed wherein all of the heat-making components situated in the positioner base, i.e., the electronics utilized by the system, dissipate heat. Thermal well 2001 is shown in the middle of the positioner base. (In this embodiment thermal well 2001 also includes a hole in the middle of it to allow environmental elements to pass through it. FIG. 13 shows a close-up of thermal well 2001 (the optional hole can be seen in the middle of thermal well 2001). FIG. 14 shows a cross section of thermal well 2001. When seen from the cross section it becomes clear that thermal well 2001 is actually male thermal conductor 2001 which couples with upper positioner base portion 2010 and prevents environmental contamination via O-rings 2003*a* and 2003*b*. Female thermal conductor 2002 couples to positioner base bottom 2011. Ring 2013 couples to ground plane 2014 of electronic circuit board 2012. Ground plane 2013 is generally highly conductive both thermally and electrically. The hole in male thermal conductor 2001 is optional. Heat dissipates through the composite positioner base upper and bottom portions and allows for the internal components to remain as cool as possible.

Thus embodiments of the invention directed to a Portable Antenna Positioner Apparatus and Method have been exemplified to one of ordinary skill in the art. The claims, however, and the full scope of any equivalents are what define the metes and bounds of the invention.

What is claimed is:

1. A portable antenna positioner comprising:

an antenna with a centrally located pivot point;

an elevation motor coupled with said antenna wherein said antenna may rotate in elevation about said centrally located pivot point;

at least one positioning arm coupled with said elevation motor at a first end of said positioning arm;

an azimuth motor coupled with said at least one positioning arm at a second end of said positioning arm wherein said azimuth motor is configured to rotate in azimuth;

said at least one positioning arm configured to fold into a stowed position through rotation of said at least one positioning arm at said second end of said positioning arm and wherein said rotation is relative to said azimuth motor;

a positioner base coupled with said azimuth motor; and, wherein said antenna may be stowed substantially parallel to said positioner base and substantially parallel with said positioning arm between said antenna and said positioner base through rotation of said antenna at said first end of said at least one positioning arm and through rotation of said at least one positioning arm at said second end around an axis parallel to a rotation axis of said elevation motor.

2. The portable antenna positioner of claim 1 further comprising:

a thermally conductive element coupled to said positioner base and further coupled thermally to electronic components located inside said positioner base wherein said positioner base dissipates heat from said electronic components;

at least one GPS receiver;

at least one magnetometer;

at least one inclinometer; and, a computer configured to utilize time and position information from said at least one GPS receiver, orientation information from said at least one magnetometer and declination information from said at least one inclinometer in order to align said antenna with said satellite.

3. The portable antenna positioner of claim 1 further comprising:

a storage device configured to store a satellite transmission, metadata regarding a satellite transmission, ephemeris data and TLE data.

4. The portable antenna positioner of claim 1 further comprising:

software configured to execute on said computer by searching in azimuth more than searching in elevation or wherein said computer is configured to utilize Clarke Belt Fallback when TLEs are over an age threshold or wherein said computer is configured to search selectably for a transponder signal or a beacon signal for a satellite.

5. The portable antenna positioner of claim 1 further comprising:

at least one leg coupled with said positioner base.

6. The portable antenna positioner of claim 1 further comprising:

a computer configured to align said antenna to point at a satellite wherein said computer housed inside said positioner base; and, a user interface coupled with said computer wherein said computer is configured to place an indicator in said user interface to indicate that said positioner based should be rotated left or right to minimize powered azimuth movement.

7. The portable antenna positioner of claim 1 further comprising:

a computer configured to align said antenna to point at a linearly polarized satellite wherein said computer housed inside said positioner base; and, a user interface coupled with said computer wherein said computer is configured to prompt an operator to rotate said antenna about the axis orthogonal to a plane in which said antenna lies to correctly align said antenna towards said linearly polarized satellite.

8. The portable antenna positioner of claim 1 further comprising:

a computer configured to align said antenna to point at a satellite wherein said computer housed inside said positioner base; and, a user interface coupled with said computer wherein said computer is configured to prompt an operator for a most likely satellite to point for a given location.

9. The portable antenna positioner of claim 1 further comprising:

a computer configured to align said antenna to point at a satellite wherein said computer housed inside said positioner base; and, a user interface coupled with said computer wherein said computer is configured to prompt an operator to input information to utilize when a failure of a component occurs.

10. The portable antenna positioner of claim 1 further comprising:

a computer configured to align said antenna to point at a satellite wherein said computer housed inside said positioner base; and, a tilt compensation element coupled to said computer wherein said computer is configured to adjust said elevation motor so that scan lines are parallel to horizontal and not to an incline to which said position base is tilted.

11. The portable antenna positioner of claim 1 further comprising:

a computer configured to align said antenna to point at a satellite wherein said computer housed inside said positioner base; and, a tilt compensation element coupled to said computer wherein said computer is configured to detect when said portable antenna positioner is bumped and reacquire said satellite.

12. The portable antenna positioner of claim 1 further comprising:

a computer configured to align said antenna to point at a satellite wherein said computer housed inside said positioner base wherein said computer is configured to search in azimuth first and sparsely search in elevation.

13. The portable antenna positioner of claim 1 further comprising:

a computer configured to align said antenna to point at a satellite wherein said computer housed inside said positioner base wherein said computer is configured to search two scan lines in azimuth above an initial location and two scan lines in azimuth below said initial location and then utilize a box search algorithm to point said antenna at a signal peak.

14. The portable antenna positioner of claim 1 further comprising:

a computer configured to align said antenna to point at a satellite wherein said computer housed inside said positioner base wherein said computer is configured to search or track said satellite based on either a transponder signal or a beacon signal output by said satellite or both.

15. The portable antenna positioner of claim 1 further comprising:

a computer configured to align said antenna to point at a geosynchronous satellite wherein said computer housed inside said positioner base wherein said computer is configured to not track said geosynchronous satellite when said geosynchronous satellite is near a top or bottom of a figure eight pattern and track said geosynchronous satellite when said geosynchronous satellite is scheduled to move from between said top or bottom of said figure eight.

16. A method for utilizing a portable antenna positioner comprising:

coupling an antenna with an elevation motor wherein said antenna comprises a centrally located pivot point and wherein said antenna is configured for rotation in elevation about said centrally located pivot point when moved by said elevation motor;

coupling at least one positioning arm with said an elevation motor at a first end of said positioning arm;

coupling said at least one positioning arm with an azimuth motor at a second end of said positioning arm wherein said azimuth motor is configured to rotate in azimuth;

configuring said at least one positioning arm to fold into a stowed position through rotation of said at least one positioning arm at said second end of said positioning arm wherein said rotation is along an axis which is parallel to a rotation axis of said elevation motor and said rotation is relative to said azimuth motor;

coupling said azimuth motor with a positioner base; and, delivering said antenna, said elevation motor, said at least one positioning arm, said azimuth motor wherein said antenna may be stowed substantially parallel to said positioner base and substantially parallel with said positioning arm between said antenna and said positioner base through rotation of said antenna at said first end of said at least one positioning arm and through rotation of said at least one positioning arm at said second end around said axis which is parallel to said rotation axis of said elevation motor.

17. The method of claim 16 further comprising:

coupling a thermally conductive element to said positioner base and further coupling said thermally conductive element to electronic components located inside said positioner base wherein said positioner base dissipates heat from said electronic components.

18. The method of claim 16 further comprising:

stowing said antenna in a stowed position proximate to said positioner base wherein said positioner arm is retracted proximate to said positioner base; and, deploying said antenna in a deployed position wherein said positioner arm is extended upward from said positioner base.

19. The method of claim 16 further comprising:

locating a satellite using timing and position data from at least one GPS receiver, orientation data from at least one magnetometer, declination data from at least one inclinometer and ephemeris data.

20. The method of claim 16 further comprising:

locating a satellite using an RSSI receiver.

21. The method of claim 16 further comprising:

receiving data and metadata from said antenna.

22. The method of claim 21 wherein said metadata comprises program information for at least one satellite channel.

23. The method of claim 16 further comprising coupling a computer with said elevation motor and said azimuth motor wherein said computer conserves power by searching in azimuth more than searching in elevation or wherein said computer is configured to utilize Clarke Belt Fallback when TLEs are over an age threshold or wherein said computer is configured to search selectably for a transponder signal or a beacon signal for a satellite.

24. The method of claim 16 further comprising:

receiving ephemeris data or TLE data from a satellite.

25. The method of claim 16 further comprising:

transmitting data via said antenna.

26. The method of claim 16 further comprising:

coupling with a module selected from the group consisting of cryptographic module, router module and power module.

27. A portable antenna positioner comprising:

an antenna with a centrally located pivot point;

an elevation motor coupled with said antenna wherein said antenna may rotate in elevation about said centrally located pivot point;

at least one positioning arm coupled with said elevation motor at a first end of said positioning arm;

an azimuth motor coupled with said at least one positioning arm at a second end of said positioning arm wherein said azimuth motor is configured to rotate in azimuth;

said at least one positioning arm configured to fold into a stowed position through rotation of said at least one positioning arm at said second end of said positioning arm and said rotation is relative to said azimuth motor;

a positioner base coupled with said azimuth motor wherein said positioner base comprises a thermally conductive element further coupled to electronic components located inside said positioner base wherein said positioner base dissipates heat from said electronic components;

wherein said antenna may be stowed substantially parallel to said positioner base and substantially parallel with said positioning arm between said antenna and said positioner base through rotation of said antenna at said first end of said at least one positioning arm and through rotation of said at least one positioning arm at said second end;

a computer configured to align said antenna to point at a satellite wherein said computer housed inside said positioner base;

at least one receiver;

at least one magnetometer;

at least one inclinometer; and, said computer configured to utilize time and position information from said at least one GPS receiver, orientation information from said at least one magnetometer and declination information from said at least one inclinometer in order to align said antenna with said satellite.

28. The portable antenna positioner of claim 27 wherein said receiver comprises a GPS receiver or a data receiver or a transmitter or an RSSI receiver.

29. The portable antenna positioner of claim 27 wherein said computer is configured to conserve power by searching in azimuth more than searching in elevation or wherein said computer is configured to utilize Clarke Belt Fallback when TLEs are over an age threshold or wherein said computer is configured to search selectably for a transponder signal or a beacon signal for a satellite.

30. The portable antenna positioner of claim 27 further comprising a thermally conductive element coupled to said positioner base and further coupled thermally to electronic components located inside said positioner base wherein said thermally positioner base dissipates heat from said electronic components.

* * * * *